US007561007B1

(12) United States Patent
Heissler

(10) Patent No.: US 7,561,007 B1
(45) Date of Patent: Jul. 14, 2009

(54) SWITCHABLE PHASE SHIFTER FOR PROVIDING SELECTABLE PHASE SHIFT PATHS

(75) Inventor: Kennith J. Heissler, Mount Laurel, NJ (US)

(73) Assignee: Lockheed Martin Corporation, Bethesda, MD (US)

( * ) Notice: Subject to any disclaimer, the term of this patent is extended or adjusted under 35 U.S.C. 154(b) by 175 days.

(21) Appl. No.: 11/498,119

(22) Filed: Aug. 2, 2006

(51) Int. Cl.
*H01P 1/18* (2006.01)

(52) U.S. Cl. ..... 333/164; 333/139; 333/117; 333/101

(58) Field of Classification Search ..... 333/139, 333/156, 164, 109, 112, 117, 118, 101
See application file for complete search history.

(56) References Cited

U.S. PATENT DOCUMENTS 3,991,390 A 11/1976 Conroy
3,999,150 A 12/1976 Caragliano et al.
4,764,740 A * 8/1988 Meyer ..... 333/164
4,777,458 A * 10/1988 Pardini ..... 333/112

OTHER PUBLICATIONS

David E. Meharry, Jay E. Sanctuary, and Bogdan A. Golja, entitled: Broad Bandwidth Transformer Coupled Differential Amplifiers for High Dynamic Range, IEEE Journal of Solid-State Circuits, vol. 34, No. 9, Sep. 1999.

* cited by examiner

*Primary Examiner*—Benny Lee
(74) *Attorney, Agent, or Firm*—Duane Morris LLP

(57) ABSTRACT

A switchable phase shifter includes an RF coupler arrangement which simultaneously produces 0° and 180° signals, together with controllable switches which select the desired phase of output signal while maintaining the coupler arrangement terminated.

6 Claims, 4 Drawing Sheets

SWITCHABLE PHASE SHIFTER FOR PROVIDING SELECTABLE PHASE SHIFT PATHS

FIELD OF THE INVENTION

This invention relates to phase shifters for electromagnetic energy, and more especially to switchable phase shifters.

BACKGROUND OF THE INVENTION

It is difficult to design switchable 0°/180° phase shifters in the context of microwave monolithic integrated circuits (MMICs), because cost factors often limit the size of the chip that can be used, which in turn limits the available surface area on which circuit structures can be defined. In addition, modern phase shifters may require broad bandwidth, minimal losses, and small phase and amplitude imbalance across the band, which tends to exacerbate the design problem.

The prior art includes switched-line, high-pass/low-pass, loaded-line, and rat-race types of phase shifters. Each has it its own advantages and disadvantages. Improved switchable 0°/180° phase shifters are desired.

SUMMARY OF THE INVENTION

A switchable phase shifter according to an aspect of the invention is for selectively phase shifting electromagnetic signals applied to an input port thereof. The phase shifter comprises first and second mutually coupled, parallel conductors, each defining first and second ports. The first port of the first conductor is coupled to a reference potential and the first port of the second conductor defines the input port of the switchable phase shifter. The switchable phase shifter also includes third and fourth mutually coupled, parallel conductors, each defining first and second ports. The first port of the third conductor is coupled to a reference potential, and the second port of the second conductor is connected to the second port of the fourth conductor, preferably galvanically. A first single-pole, double throw switch includes a common port and first and second individually selectable ports. The common port of the first single-pole, double throw switch is connected to the second port of the first conductor, preferably galvanically, and a second port of the first single pole, double throw switch is connected to a first termination, which may be a matched termination. A second single-pole, double throw switch includes a common port and first and second individually selectable ports. The common port of the second single-pole, double throw switch is connected to the second port of the third conductor, preferably galvanically, and a second port of the second single pole, double throw switch is connected to a second termination, which may be a matched termination. A control arrangement is coupled to the first and second single-pole, double-throw switches, for, in a first state of the first and second single-pole, double-throw switches, controlling the first single-pole, double-throw switch to couple the second port of the first conductor to the first matched termination concurrent with coupling of the second port of the third conductor to the output port of the phase shifter, and in a second state, for controlling the second single-pole, double-throw switch to couple the second port of the third conductor to the second matched termination concurrent with coupling of the second port of the first conductor to the output port of the phase shifter.

In a preferred embodiment of the phase shifter, the first, second, third, and fourth conductors are in the form of strip conductors overlying a ground plane to thereby define microstrip transmission lines. In a preferred embodiment, the first and second parallel conductors are wound in a generally planar first spiral, and said third and fourth parallel conductors are wound in a generally planar second spiral. The two spirals may be coplanar and are preferably not coaxial.

DESCRIPTION OF THE INVENTION

Figure 1:
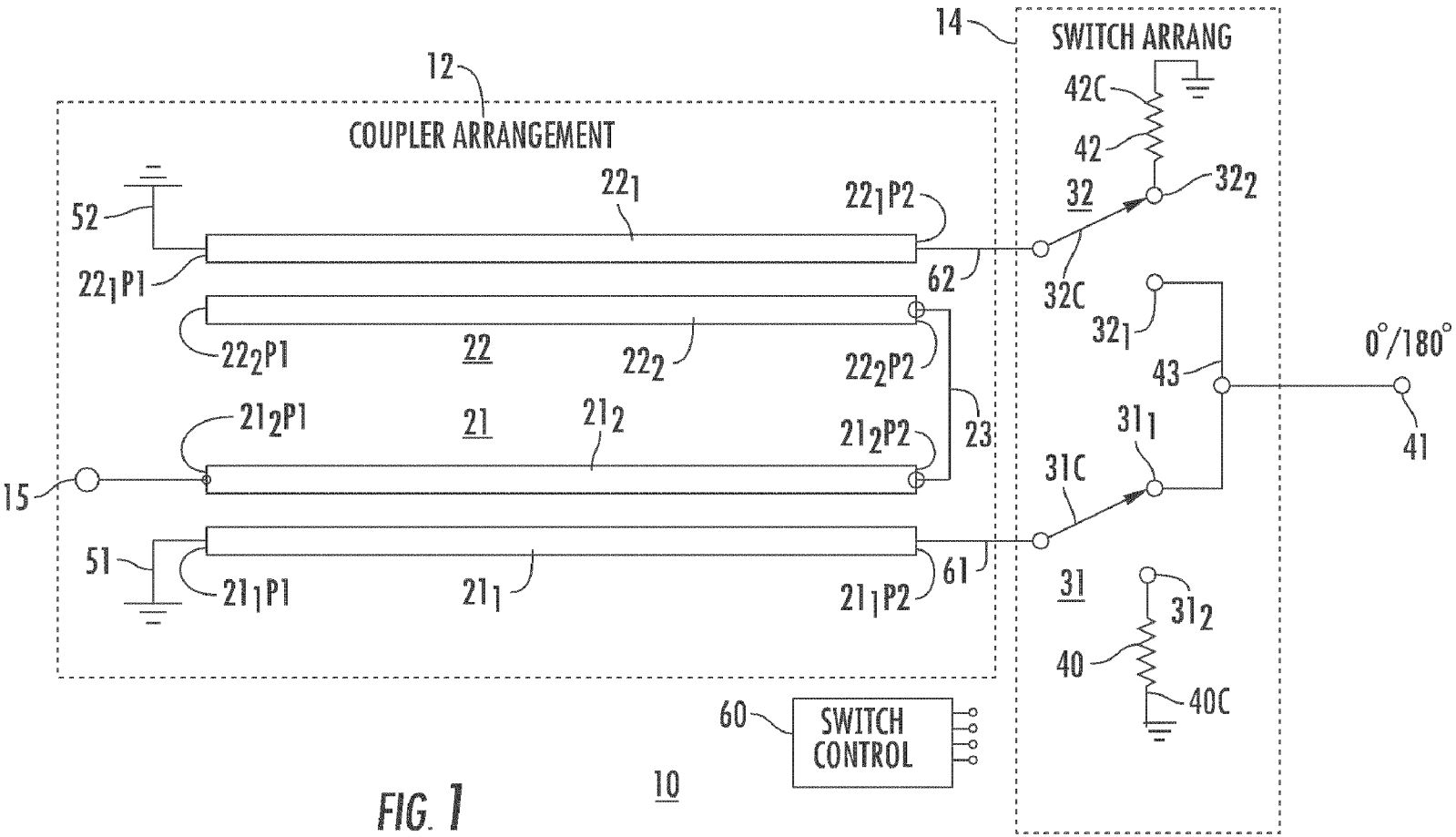
FIG. 1 is a simplified schematic diagram illustrating some aspects of a phase shifter according to an aspect of the invention.

FIG. 1 illustrates a hardware version of one aspect of the invention. In FIG. 1, a switchable or controllable phase shifter is designated generally as 10. Switchable phase shifter 10 includes a coupler arrangement designated generally as 12 and a switch arrangement designated generally as 14. Coupler arrangement 12 includes first and second 3 dB coupler arrangements designated generally as 21 and 22. First 3-dB coupler 21 includes a first elongated electrical conductor $\mathbf{21}_1$. Conductor $\mathbf{21}_1$ is laid out in a straight line for ease of understanding. A first end of conductor $\mathbf{21}_1$ defines a first port $\mathbf{21}_1p\mathbf{1}$, and a second end defines a second port $\mathbf{21}_1p\mathbf{2}$. First 3-dB coupler 21 includes a second straight, elongated electrical conductor $\mathbf{21}_2$, which defines a first port $\mathbf{21}_2p\mathbf{1}$ and a second port $\mathbf{21}_2p\mathbf{2}$. The first port $\mathbf{21}_2p\mathbf{1}$ of conductor $\mathbf{21}_2$ is the input port of coupler arrangement 12, as suggested by connection point 15. Second electrical conductor $\mathbf{21}_2$ lies parallel to first electrical conductor $\mathbf{21}_1$ and close enough thereto to provide substantial mutual coupling, as known in the coupler art. Port $\mathbf{21}_1p\mathbf{1}$ of conductor $\mathbf{21}_1$ lies at the same end of the parallel conductors $\mathbf{21}_1$ and $\mathbf{21}_2$ as port $\mathbf{21}_2p\mathbf{1}$ of conductor $\mathbf{21}_2$, and concomitantly port $\mathbf{21}_1p\mathbf{2}$ of conductor $\mathbf{21}_1$ lies at the same end of the parallel conductors $\mathbf{21}_1$ and $\mathbf{21}_2$ as port $\mathbf{21}_2p\mathbf{2}$ of conductor $\mathbf{21}_2$. As illustrated in FIG. 1, first port $\mathbf{21}_1p\mathbf{1}$ of conductor $\mathbf{21}_1$ is connected by way of a path 51 to a reference potential, which is illustrated as being ground.

Second 3 dB coupler arrangement 22 of FIG. 1 includes a third elongated electrical conductor $\mathbf{22}_1$. Conductor $\mathbf{22}_1$ is laid out in a straight line for ease of understanding. A first end of conductor $\mathbf{22}_1$ defines a first port $\mathbf{22}_1p\mathbf{1}$, and a second end defines a second port $\mathbf{22}_1p\mathbf{2}$. Second 3-dB coupler 22 includes a fourth straight, elongated electrical conductor $\mathbf{22}_2$, which defines a first port $\mathbf{22}_2p\mathbf{1}$ and a second port $\mathbf{22}_2p\mathbf{2}$. The first port $\mathbf{22}_2p\mathbf{1}$ of conductor $\mathbf{22}_2$ is open-circuited. Fourth electrical conductor $\mathbf{22}_2$ lies parallel to third electrical conductor $\mathbf{22}_1$ and close enough thereto to provide substantial mutual coupling, as known in the coupler art. Port $\mathbf{22}_1p\mathbf{1}$ of conductor $\mathbf{22}_1$ lies at the same end of the parallel conductors $\mathbf{22}_1$ and $\mathbf{22}_2$ as port $\mathbf{22}_2p\mathbf{1}$ of conductor $\mathbf{22}_2$, and concomitantly port $\mathbf{22}_1p\mathbf{2}$ of conductor $\mathbf{22}_1$ lies at the same end of the parallel conductors $\mathbf{22}_1$ and $\mathbf{22}_2$ as port $\mathbf{22}_2p\mathbf{2}$ of conductor $\mathbf{22}_2$. As illustrated in FIG. 1, first port $\mathbf{22}_1p\mathbf{1}$ of conductor $\mathbf{22}_1$ is connected by a path 52 to a reference potential, which is illustrated as being ground.

According to an aspect of the invention, second ports $\mathbf{21}_2p\mathbf{2}$ and $\mathbf{22}_2p\mathbf{2}$ are interconnected by a conductor 23.

Electromagnetic signals applied to input port 15 of switchable phase shifter 10 of FIG. 1 are coupled to first port $\mathbf{21}_2p\mathbf{1}$ of conductor $\mathbf{21}_2$, and flow to other ports of the coupler arrangement 21, as known in the art. In particular, the signal produced at through port $\mathbf{21}_2p\mathbf{2}$ has a phase shift or delay of 90°, and the signal appearing at coupled port $\mathbf{21}_1p\mathbf{2}$ has a phase shift of 180°. The signals having a phase shift of 90° produced at through or output port $\mathbf{21}_2p\mathbf{2}$ of conductor $\mathbf{21}_2$ are applied to port $\mathbf{22}_2p\mathbf{2}$ of conductor $\mathbf{22}_2$ of coupler 22.

As so far described, the coupler arrangement 12 of FIG. 1 substantially corresponds with the equivalent circuit of a transformer or balun described in the article *Broad Bandwidth Transformer Coupled Differential Amplifiers for High Dynamic Range*, authored by David E. Meharry, Jay E. Sanctuary, and Bogdan A. Golja and published at pp 1233-1238 of IEEE Journal of Solid-State Circuits, Vol 34, No. 9, September 1999. The coupler arrangement 12 of FIG. 1 produces 180° signal at its output conductor or port 61 and 0° signal at its output port 62 when ports 61 and 62 are terminated in the characteristic impedance of the transmission lines of which conductors $\mathbf{21}_1$, $\mathbf{21}_2$, $\mathbf{22}_1$, and $\mathbf{22}_2$ are part of. The signals coupled to ports or conductors 61 and 62 from input port 15 are each theoretically attenuated or reduced in amplitude by 3 dB (half power at each port).

Switchable phase shifter 10 of FIG. 1 also includes a switch section 14. Switch section 14 includes a first single-pole, double-throw switch 31, illustrated by a mechanical switch symbol. Those skilled in the art know that mechanical switches have little use for microcircuits or for frequencies above one or two gigahertz (GHz), and solid-state switches are used instead. Nevertheless, the mechanical switch symbol is useful for explanatory purposes. Switch 31 includes a common "movable" element 31*c*, which connects alternately to a switch terminal $\mathbf{31}_1$ or a switch terminal $\mathbf{31}_2$ under the switch control of a control circuit illustrated as a block 60. Switch terminal $\mathbf{31}_1$ is connected by way of a path 43 to a port 41, which represents the 0°/180° output port of the switchable phase shifter 10. Switch terminal $\mathbf{31}_2$ is connected by way of a termination 40 and a path 40*c* to a reference potential illustrated as ground. While termination 40 is illustrated by a resistor symbol, those skilled in the art know that such terminations may have reactive components as well. Switch section 14 of FIG. 1 also includes a second single-pole, double-throw switch 32, also illustrated by a mechanical switch symbol. Switch 32 includes a common "movable" element 32*c*, which connects alternately to a switch terminal $\mathbf{32}_1$ or terminal $\mathbf{32}_2$ under the control switch of control circuit 60. Switch terminal $\mathbf{32}_1$ is also connected to 0°/180° output port 41 of switchable phase shifter 10. Switch terminal 322 is connected by way of a termination 42 and a path 42*c* to a reference potential illustrated as ground. Termination 42 is illustrated by a resistor symbol.

Port $\mathbf{21}_1p\mathbf{2}$ of conductor 21, of coupler arrangement 12 of FIG. 1 is coupled by way of a path designated as 61 to movable terminal 31*c* of switch 31. Similarly, port $\mathbf{22}_1p\mathbf{2}$ of conductor $\mathbf{22}_1$ of coupler arrangement 12 of FIG. 1 is coupled by way of a path designated as 62 to movable terminal 32*c* of switch 31. This interconnects the coupler arrangement 12 with the switch arrangement 14, so that the state of the switches of the switch arrangement 14 sets the termination arrangement of the coupler arrangement 14, and also selects the desired output phase.

Figure 2:
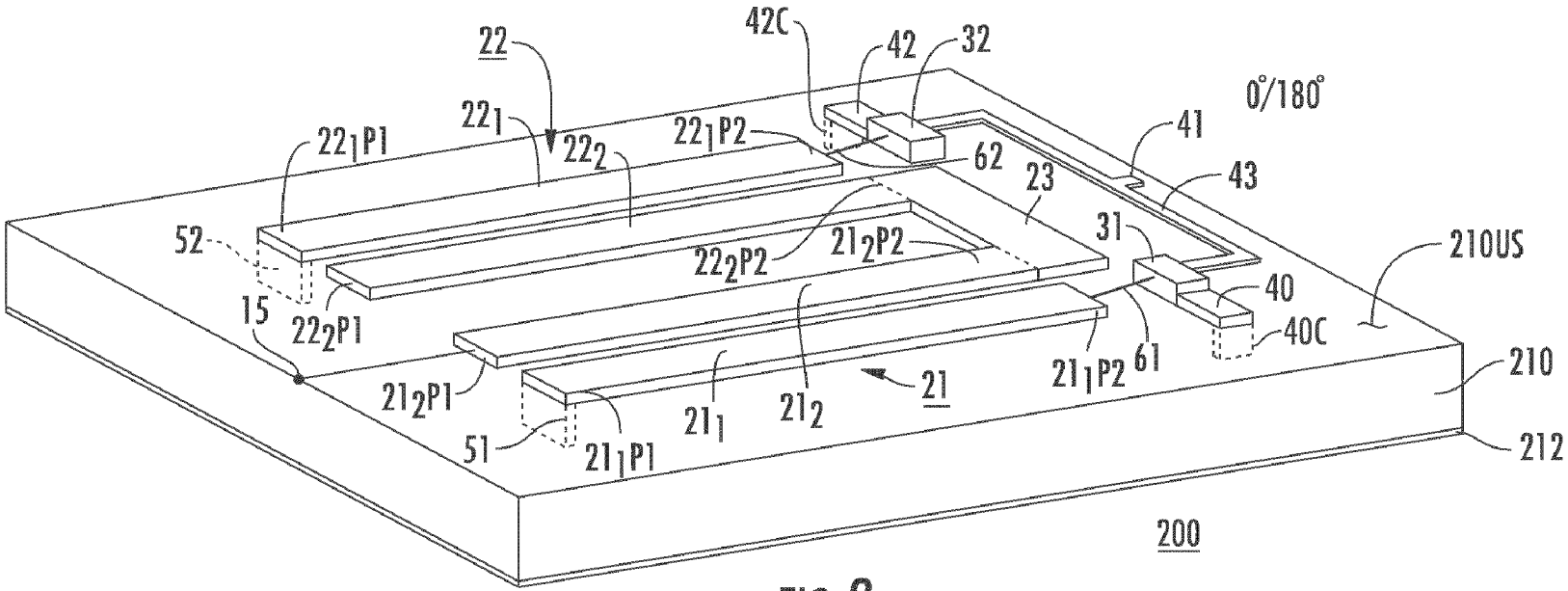
FIG. 2 is a simplified perspective or isometric view of a portion of a dielectric substrate overlying a ground plane and defining stripline conductors with interconnections.

FIG. 2 is a simplified perspective or isometric view of a microcircuit structure 200 corresponding to phase shifter arrangement 10 of FIG. 1. Elements corresponding to those of FIG. 1 are designated by like reference numerals and further description of these elements may be omitted in the description of this drawing figure. In FIG. 2, structure 200 includes a low-loss dielectric plate or substrate 210 defining a generally planar broad upper surface 210*us*. An electrically conductive ground plane 212 is affixed to a broad lower surface of dielectric plate 210. In FIG. 2, the connection of elements to reference potential is accomplished by electrical conductors extending vertically through the dielectric substrate 210, as for example by one or more through vias. Such electrical connections may be used to ground electrical devices, such as resistors 40 and 42, illustrated as planar rectangular elements. Electrical connections from the upper surface 210*us* to the underlying ground plane 212 are illustrated at 40*c*, 42*c*, 51, and 52. The switches 31 and 32 are illustrated in FIG. 2 by rectangular microchips.

The dimensions of the microcircuit on which the switchable phase shifter 10 of FIGS. 1 and 2 is defined are reduced by coiling into spirals the pairs of elongated conductors making up the couplers 21 and 22. Such spirals of mutually coupled conductors or transmission lines are known per se in the context of coaxial planar spirals with ground planes on either side of the spiral pair, as described in U.S. Pat. No. 3,999,150, issued Dec. 21, 1976 in the name of Caragliano et al. This Caragliano et al. structure requires four layers of electrical conductors (the upper and lower ground planes and the two coaxial planar spirals), together with at least three layers of isolating dielectric. Such multiple-layer structures are difficult to fabricate as microwave integrated circuits.

Figure 3A:
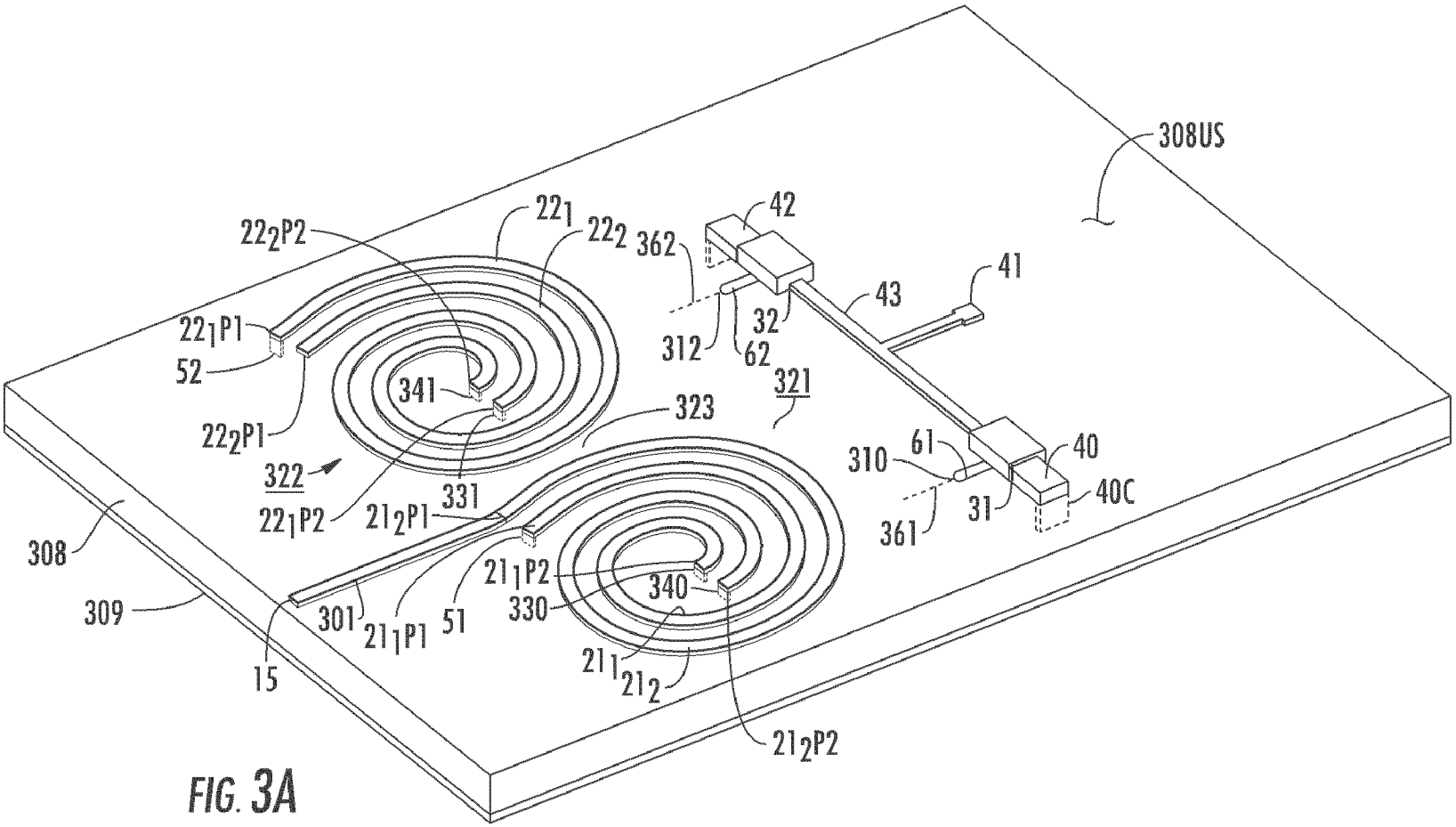
FIG. 3*a* is a simplified perspective or isometric view of a the upper portion of a structure such as that of FIG. 2, with certain conductors wound into a spiral.
Figure 3B:
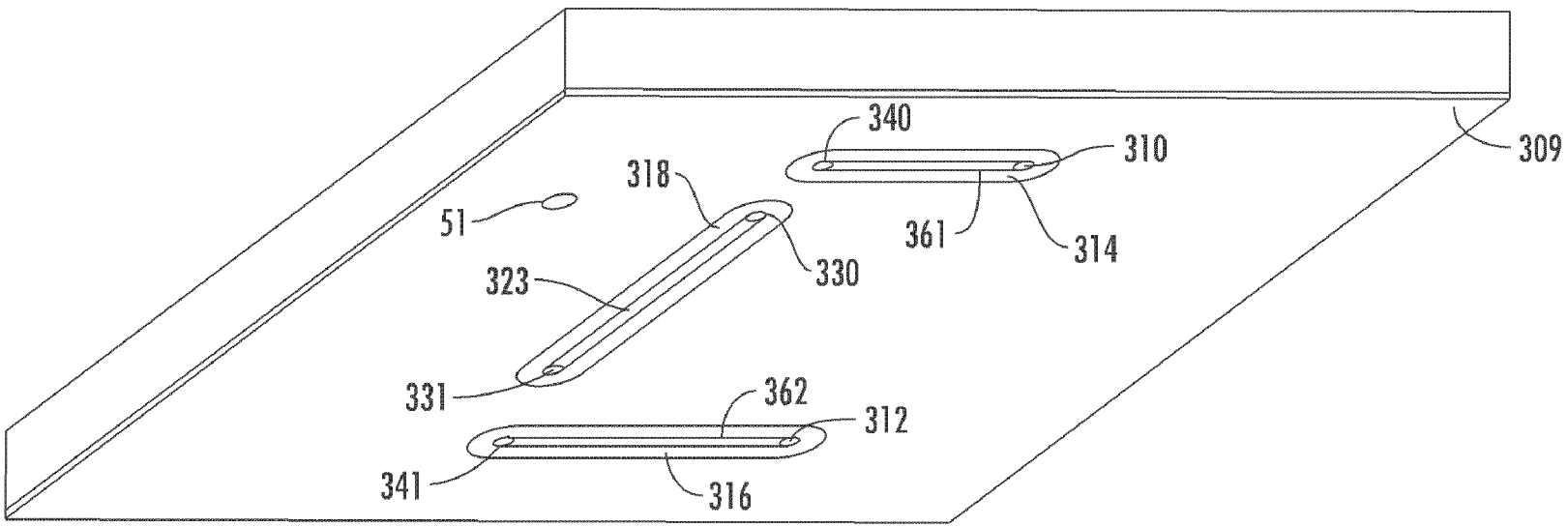
FIG. 3*b* is a bottom view of the arrangement of FIG. 3*a*.

FIG. 3*a* is a simplified perspective or isometric view of some details of the upper surface 308*us* of a microwave substrate 308, the lower surface of which bears a ground conductor or plane 309. FIG. 3*b* illustrates details of the ground-plane or reverse side of the substrate 308 of FIG. 3*a*. In FIG. 3*a*, elements corresponding to those of FIGS. 1 and 2 are designated by like reference numerals and further description of these elements may be omitted in the description of this drawing figure. In FIG. 3*a*, the elongated conductor pair $\mathbf{21}_1$, $\mathbf{21}_2$ is wound into an individual multiturn planar spiral designated 321 (corresponding to coupler 21 of FIGS. 1 and 2), and elongated conductor pair $\mathbf{22}_1$, $\mathbf{22}_2$ is wound into an individual multiturn planar spiral designated 322 (corresponding to coupler 22 of FIGS. 1 and 2). Spirals 321 and 322 are not coaxial, but instead lie side-by-side. In FIG. 3*a*, input port 15 is connected by way of a conductor 301 on the upper surface 308*us* to port $\mathbf{21}_2p\mathbf{1}$ of conductor $\mathbf{21}_2$. Port $\mathbf{21}_1p\mathbf{1}$ is connected to ground plane 309 by a through via 51. Port $\mathbf{22}_2p\mathbf{1}$ is open-circuited, and port $\mathbf{22}_1p\mathbf{1}$ is connected to ground plane 309 by a through via 52.

The remainder of the connections required in the arrangement of FIG. 3*a* to constitute the switchable phase shifter structure of FIG. 1 or 2 cannot be accomplished on the upper surface 308*us*. Instead, referring simultaneously to FIG. 3*a* and FIG. 3*b*, the connection of port $\mathbf{21}_2p\mathbf{2}$ to port $\mathbf{22}_2p\mathbf{2}$ (by conductor 23 in FIGS. 1 and 2) is accomplished by a through via 330 extending from port $\mathbf{21}_2p\mathbf{2}$ downward to an end of a conductor 323 (FIG. 3*b*) defined in an opening or aperture 318 (FIG. 3*b*) in ground plane 309, and by a further through via 331 (FIG. 3*b*) extending from the other end of conductor 323 to port $\mathbf{22}_2p\mathbf{2}$. Also, the connection of port $\mathbf{21}_1p\mathbf{2}$ to switch 31 is provided by a through via 340 connecting port $\mathbf{21}_1p\mathbf{2}$ to a first end of a conductor 361 lying in an opening 314 in ground plane 309, and by a second through via 310 connecting the other end of conductor 361 to conductor 61 on the upper surface 308*us*. Similarly, the connection of port $\mathbf{22}_1p\mathbf{2}$ to switch 32 is provided by a through via 341 connecting port $\mathbf{22}_1p\mathbf{2}$ to a first end of a conductor 362 lying in an opening 316 in ground plane 309, and by a second through via 312 connecting the other end of conductor 362 to conductor 62 on the upper surface 308*us*.

In operation of the switchable phase shifter of the invention, switch controller 60 operates movable elements 31*c* and 32*c* (FIG. 1) in a ganged manner, so that conductor 61 is, in a first state of the switches, connected to termination 40 concurrently with the connection of conductor 62 to 0°/180° output port 41, and in a second state of the switches conductor 61 is connected to 0°/180° output port 41 concurrently with the connection of conductor 62 to termination 42. Switching between the first and second states of the switches causes the signal at output port 41 to alternate between 0° and 180° relative phase shift states.

While the connections between and among the planar coils have been described as being at by isolated conductors lying in the same plane as the ground, these connections can instead be made by the use of bond wires taken above the upper surface of the substrate.

What is claimed is:

1. A switchable phase shifter for selectively phase shifting electromagnetic signals applied to an input port thereof, the phase shifter comprising:

first and second mutually coupled, parallel conductors, each defining first and second ports, the first port of the first conductor being coupled to a reference potential and the first port of the second conductor defining the input port of the switchable phase shifter;

third and fourth mutually coupled, parallel conductors, each defining first and second ports, the first port of the third conductor being coupled to a reference potential, and the second port of the second conductor being connected to the second port of the fourth conductor;

a first single-pole, double throw switch including a common port and first and second individually selectable ports, the common port of the first single-pole, double throw switch being connected to the second port of the first conductor, and a second port of the first single pole, double throw switch being connected to a first termination;

a second single-pole, double throw switch including a common port and first and second individually selectable ports, the common port of the second single-pole, double throw switch being connected to the second port of the third conductor, and the second port of the second single pole, double throw switch being connected to a second termination;

control means coupled to the first and second single-pole, double-throw switches, for, in a first state, controlling the first single-pole, double-throw switch to couple the second port of the first conductor to the first termination concurrent with coupling of the second port of the third conductor to an output port of the phase shifter, and in a second state, for controlling the second single-pole, double-throw switch to couple the second port of the third conductor to the second matched termination concurrent with coupling of the second port of the first conductor to said output port of the phase shifter.

2. A phase shifter according to claim 1, wherein the first and second parallel conductors are wound in a generally planar first spiral, and said third and fourth parallel conductors are wound in a generally planar second spiral.

3. A phase shifter according to claim 2, wherein said first and second spirals are non-coaxial.

4. A phase shifter according to claim 1, wherein said first, second, third, and fourth conductors are in the form of strip conductors overlying a ground plane to thereby define microstrip transmission lines.

5. A phase shifter according to claim 1 in which each of said first, second, third, and fourth parallel conductors defines a characteristic impedance, and said terminations are matched to said characteristic impedance.

6. A phase shifter according to claim 1, wherein said common port of the first single-pole, double throw switch is galvanically connected to the second port of the first conductor and said common port of the second single-pole, double throw switch is galvanically connected to the second port of the third conductor.

* * * * *